US005308825A

United States Patent [19]

Defieuw

[11] Patent Number: 5,308,825

[45] Date of Patent: May 3, 1994

[54] DESCRIPTION

[75] Inventor: Geert H. Defieuw, Kessel-Lo, Belgium

[73] Assignee: AGFA-Gevaert, N.V., Mortsel, Belgium

[21] Appl. No.: 903,329

[22] Filed: Jun. 24, 1992

[30] Foreign Application Priority Data

Jul. 12, 1991 [EP] European Pat. Off. ..... 91201826.4

[51] Int. Cl.[5] ..... B41M 5/035; B41M 5/38

[52] U.S. Cl. ..... 503/227; 428/195; 428/212; 428/423.7; 428/913; 428/914

[58] Field of Search ..... 8/471; 428/195, 913, 428/914, 212, 423.1, 423.7, 480, 500, 520; 503/227

[56] References Cited

U.S. PATENT DOCUMENTS 4,816,435 3/1989 Murata et al. ..... 503/227
4,833,124 5/1989 Lum ..... 503/227

FOREIGN PATENT DOCUMENTS 0318946 6/1989 European Pat. Off. ..... 503/227
0453020 10/1991 European Pat. Off. ..... 503/227
1-136787 5/1989 Japan ..... 503/227

*Primary Examiner*—B. Hamilton Hess
*Attorney, Agent, or Firm*—Breiner & Breiner

[57] ABSTRACT

Thermal dye transfer printing method for obtaining high density black images comprising the steps of (1) imagewise heating a first area of a dye-donor element or a first dye-donor element comprising a support having thereon a dye layer containing a dye or a mixture of dyes thereby transferring a first dye image to a dye-receiving element comprising a support having thereon a dye image-receiving layer and (2) subsequently imagewise heating a second area of said dye-donor element or a second dye donor element thereby transferring in register with the first dye image a second dye image to said dye-receiving element wherein the superposition of the first transferred dye image and the second transferred dye image yield a black dye image, characterized in that the concentration of those essential composing dyes having a higher retransfer degree than the other essential composing dyes is higher in the second area or in the second dye-donor element than in the first area or first dye-donor element, and dye-donor element for use according to said method.

10 Claims, No Drawings

DESCRIPTION

DESCRIPTION

1. Field of the Invention

The present invention relates to a thermal dye sublimation transfer method for printing black images and to dye-donor elements for use according to said method.

2. Background of the Invention

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

For recording black images by thermal dye sublimation transfer, transfer is performed either by sequentially transferring in register a cyan image, a magenta image and a yellow image in three passes or by transferring a black image in a single pass by using a dye-donor element having a black colored dye layer containing a mixture of yellow, magenta and cyan colored dyes. Mixtures of yellow, magenta and cyan dyes for the formation of a black colored dye later are described in e.g. EP 453020, U.S. Pat. No. 4,816,435 and JP 01/136787.

The density of the transferred black image obtained by printing according to one of the above methods is too low, especially when transfer is effected onto a transparant material.

In EP 318946 there is described a method for increasing the density of i.a. a black dye transfer image comprising the steps of imagewise heating a black colored dye-donor element containing a mixture of cyan, magenta and yellow dyes thereby transferring a first black dye image to the receiver sheet and subsequently imagewise heating another unused portion of the same black colored dye-donor element or another dye-donor element containing the same mixture of dyes thereby transferring in register with the first black dye image a second black dye image of the same hue to the receiver sheet.

This method has the disadvantage that during the second printing pass one or more of the dyes already transferred in the first pass partially retransfer to the donor element leading to a loss in density possibly together with a spectral shift in the black image (due to the different retransfer ratios of the dyes).

SUMMARY OF THE INVENTION

Therefore it is an object of the present invention to provide a thermal dye transfer printing method for obtaining high density black images not having the disadvantages mentioned above.

According to the present invention a thermal dye transfer printing method for obtaining high density black images is provided, said method comprising the steps of (1) imagewise heating a first area of a dye-donor element or a first dye-donor element comprising a support having thereon a dye layer containing a dye or a mixture of dyes thereby transferring a first dye image to a dye-receiving element comprising a support having thereon a dye image-receiving layer and (2) subsequently imagewise heating a second area of said dye-donor element or a second dye-donor element thereby transferring in register with the first dye image a second dye image to said dye-receiving element wherein the superposition of the first transferred dye image and the second transferred dye image yield a black dye image, characterized in that the concentration of those essential composing dyes having a higher retransfer degree than the other essential composing dyes is higher in the second area or in the second dye-donor element than in the first area or first dye-donor element.

By essential composing dyes is meant: the composing dyes (i.e. the dyes making up the black color) making an essential contribution to the density of the obtained dye image i.e. a contribution to the density in the red, green or blue region of at least 30%.

In a preferred embodiment of the present invention the dye-donor element for use in the method according to the present invention is a dye-donor element having sequential repeating first and second areas each containing a dye or a mixture of dyes having the same or different color wherein said first and second areas either contain different dyes or dye mixtures with the essential composing dyes having a higher retransfer degree being present in the second area or contain the same dyes but in different concentrations with the essential composing dyes having a higher retransfer degree being present in the second area in a higher concentration than in the first area, the dyes in the first and second area being selected so that the superposition of the first dye image and the second dye image gives a dense black image. Due to the fact that the two areas contain different dyes or different concentrations of dyes the dye image transferred from the first area may have a different hue than the dye image transferred from the second area.

The method of the present invention for obtaining high density black images is also applicable to thermal dye transfer printing in three passes instead of in two passes using three dye areas whereby the concentration of essential composing dyes having a higher retransfer degree than the other essential composing dyes is higher in an area to be printed in a later pass than in an area to be printed in an earlier pass and whereby at least one of the three dye areas contains a mixture of dyes wherein at least two dyes have a difference in absorption maximum of at least 50 nm, i.e.,are differently colored dyes.

Of course, the principle of providing those dyes having a higher retransfer degree in a higher concentration in an area or dye-donor element to be printed in a later pass than in an area or dye-donor element to be printed in an earlier pass is also applicable to the printing of multicolored images or black-and-white images by sequentially performing the dye transfer process steps for each color making use of dye-donor elements having sequential repeating areas of different colored dyes (thus in three passes or in six passes if the above principle is supplementary applied to the dye mixture used for each color).

DETAILED DESCRIPTION OF THE INVENTION

The dyes that are used in the subsequent dye areas of the dye-donor element or subsequent dye-donor elements according to the present invention are selected so that the superposition of the subsequent transferred dye images yield a black image. A black image is obtained by using a neutral-hue dye (i.e. a black dye) or by superposition of a magenta dye or a mixture of magenta dyes, a cyan dye or a mixture of cyan dyes and a yellow dye or a mixture of yellow dyes.

According to one embodiment of the present invention one dye area or donor element contains some of the essential composing dyes and the other area or donor element contains the other essential composing dyes. The area or donor element to be printed in the last pass then contains those essential composing dyes having a higher retransfer degree than the other essential composing dyes.

According to another embodiment of the present invention all the dye areas or donor elements contain all the composing dyes and the area or donor element to be printed in the last pass then contains the essential composing dyes having a higher retransfer degree than the other essential composing dyes in a higher concentration than the area or donor element to be printed in an earlier pass.

According to another embodiment some of the essential composing dyes are contained in all the dye areas or donor elements and other essential composing dyes are contained in only one of the dye areas or donor elements.

Usually those dyes that have a higher molecular weight and/or that are more polar have a lower retransfer degree than dyes that have a lower molecular weight and/or that are less polar.

The phenomenon of retransfer is described more fully in Journal of Imaging Science, Vol. 35, No. 4, pages 263–273.

Dye-donor elements according to the present invention satisfy the following condition: the sum of the color densities of the superposed transferred image in the red, green and blue region (sum D) is higher if the first area or first dye-donor element is printed in the first pass and the second area or second dye-donor element is printed in the second pass (with the second area or second dye-donor element containing those essential composing dyes having a higher retransfer degree than other essential composing dyes in a higher concentration than the first area or first dye-donor element) than vice versa (i.e. if the second area or second dye-donor element is printed in the first pass and the first area or first dye-donor element is printed in the second pass). Usually the difference is sum D between these two printing methods is at least 0.1.

To obtain a visual black color it is preferred that a least one of the composing dyes satisfies the following conditions: $(D_1+D_2)/D_{max} \geqq 1.5$ and $D_1 \geqq D_{max}/2$ and $D_2 \geqq D_{max}/2$ wherein $D_{max}$ is the density of a transferred pixel of said dye at the wavelength of maximum density, $D_1$ is the density of a transferred pixel of said dye at 595 nm (i.e. the wavelength of maximum eye sensitivity for red) and $D_2$ is the density of a transferred pixel of said dye at 555 nm (i.e. the wavelength of maximum eye sensitivity for green), as is described in EP 453020.

Of the dyes that satisfy the above equations especially magenta 4-chloro, 5-formylthiazol-2-ylazoaniline dyes are preferred.

4-Chloro, 5-formylthiazol-2-ylazoaniline dyes for use according to the present invention can be represented by the following formula

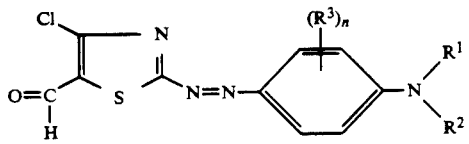

wherein:

$R^1$ and $R^2$ each independently represent hydrogen, a substituted or unsubstituted alkyl group, a substituted or unsubstituted cycloalkyl group, a substituted or unsubstituted aryl group, a substituted or unsubstituted allyl group, a substituted or unsubstituted alkenyl group, or $R^1$ and $R^2$ together with the nitrogen to which they are attached form the necessary atoms to close a 5- or 6-membered heterocyclic ring, or $R^1$ and/or $R^2$ together with the nitrogen to which they are attached and either or both carbon atoms or the phenyl ring ortho to said nitrogen atom form a 5- or 6-membered heterocyclic ring;

$R^3$ represents a halogen atom, a hydroxy group, acyano group, a substituted or unsubstituted alkyl group, a substituted or unsubstituted cycloalkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted amino group, a substituted or unsubstituted alkylcarbonylamino group, a substituted or unsubstituted arylcarbonylamino group, a substituted or unsubstituted alkylsufonylamino group a substituted or unsubstituted arylsulfonylamino group, a substituted or unsubstituted alkoxycarbonylamino group, a substituted or unsubstituted aryloxycarbonylamino group, a substituted or unsubstituted alkylthiocarbonylamino group, a substituted or unsubstituted arylthiocarbonylamino group, a substituted or unsubstituted alkylphosphoramidate group, a substituted or unsubstituted arylphosphoramidate group, a substituted or unsubstituted alkylphosphonamidate group, a substituted or unsubstituted arylphosphonamidate group;

n represents 0, 1, 2, 3 or 4; the $R^3$ substituents may be the same or different when n is greater than 1.

Examples of magenta 4-chloro, 5-formylthiazol-2-ylazoaniline dyes corresponding to the above formula are described in EP 453020.

A preferred magenta 4-chloro, 5-formylthiazol-2-ylazoaniline dye is

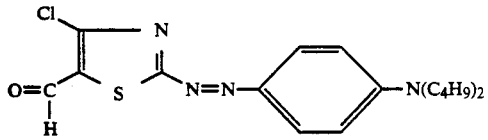
(M1)

Suitable cyan dyes for use together with the magenta 4-chloro, 5-formylthiazol-2-ylazoaniline dye in the formation of a black image include the cyan dyes described in EP 400706, the cyan dyes described in U.S. Pat No. 4,816,435, the cyan dyes obtained by chain elongation of the formyl substituent of the magenta 4-chloro, 5-formylthiazol-2-ylazoaniline dye with an active methylene function such as described in EP 352006 and cyan indoaniline dyes as described in U.S. Pat. No. 4,829,047.

Examples of suitable cyan dyes are described in EP 453020.

Preferred cyan dyes are

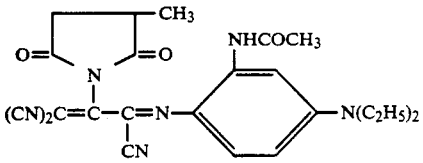
(C1)

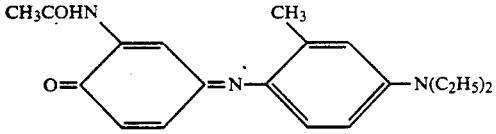
(C2)

Yellow dyes for use together with the magenta 4-chloro, 5-formylthiazol-2-ylazoaniline dye in the formation of a black image include the yellow dyes described in EP 400706, the yellow dyes described in EP 432314, the yellow dyes described in EP 432829, the yellow dyes described in EP 432313 and the yellow dyes described in U.S. Pat. No. 4,816,435 and U.S. Pat. No. 4,833,123.

Examples of suitable yellow dyes are described in EP 453020.

Preferred yellow dyes are

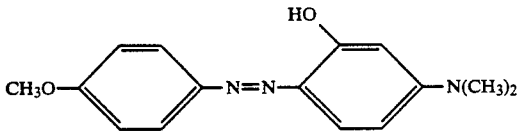
(Y1)

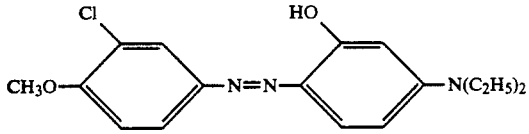
(Y2)

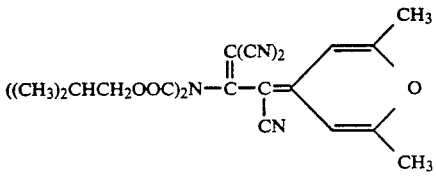
(Y3)

In a preferred embodiment of the present invention the two dye areas or donor elements contain the same dyes M1, C2 and Y2 but in different concentrations, in the first dye are or donor element 8.8 wt % M1, 5.6 wt % C2, 3.2 wt % Y2 and in the second dye area or donor element 7.2 wt % M1, 4 wt % C2, 6.4 wt % Y2, dye Y2 being the dye with the highest retransfer degree. Due to this difference in concentration the two dye images transferred in the two passes have a different hue, the first dye image being bluish and the second dye image being brownish.

The dye layer of the thermal dye sublimation transfer donor element according to the present invention is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 um, preferably 0.4 to 2.0 um, and the amount ratio of dye or dye mixture to binder is between 9:1 and 1:3 by weight, preferably between 2:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetatepentanoate, cellulose acetate benzoate, cellulose triacetate; vinyl-type resins and derivates, such as polyvinly alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or poly(styrene-co-acrylonitrile) is used as binder for the dye layer of the present invention.

The coating layer may also contain other additives, such as thermal solvents, stabilizers, curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temper. tures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 um. The support may also be coated with an adhesive or subbing layer, if desired. Examples of suitable subbing layers are described, for example, in EP 433496, EP 311841, EP 268179, U.S. Pat. No. 4,727,057, U.S. Pat. No. 4,695,288.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethylmethacrylate grated gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483,EP 227090, U.S. Pat. No. 4,567,113, 4,572,860, 4,717,711. Preferably the slipping layer comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

The support for the receiver sheet that is used with the dye-donor element maybe a transparant film of e.g. polyethylene terephthalate, a polyether sulfone, a polyimide, a cellulose ester or a polyvinyl alcohol-co-acetal. The support may also be a reflective one such as baryta-coated paper, polyethylene-coated paper or white polyester i.e. white-pigmented polyester. Blue-colored polyethylene terephthalate film can also be used as support.

To avoid poor adsorption of the transferred dye to the support of the receiver sheet this support must be coated with a special surface, a dye-image-receiving layer, into which the dye can diffuse more readily. The dye-image-receiving layer may comprise, for example, a polycarbonate, a polyurethane, a polyester, a polyamide, polyvinyl chloride, polystyrene-co-acrylonitrile, polycaprolactone or mixtures thereof. Suitable dye-receiving layers have been described in e.g. EP 133011, EP 133012, EP 144247, EP 227094, EP 228066. The dye-image-receiving layer may also comprise a cured binder such as the heat-cured product of poly(vinylchloride-co-vinylacetate-co-vinylalcohol) and polyisocyanate.

In order to improve the light resistance and other stabilities of recorded images, UV absorbers, singlet oxygen quenchers such as HALS-compounds (Hindered Amine Light Stabilizers) and/or antioxidants may be incorporated into the receiving layer.

The dye layer of the dye-donor element or the dye-image-receiving layer of the receiver sheet may also contain a releasing agent that aids in separating the dye-donor element from the dye-receiving element after transfer. The releasing agents can also be applied in a separate layer on at least part of the dye layer or of the receiving layer. For the releasing agent solid waxes, fluorine- or phosphate-containing surfactants and silicone oils are used. Suitable releasing agents are described in e.g. EP 133012, JP 85/19138, EP 227092.

The thermal dye sublimation transfer printing process comprises placing the dye layer of the donor element in face-to-face relation with the dye-receiving layer of the receiver sheet and imagewise heating from the back of the donor element. The transfer of the dye is accomplished by heating for about several milliseconds at a temperature of about 400° C.

In the method of the present invention the process steps described above are performed sequentially for each dye area or dye-donor element. The above sandwich of donor element and receiver sheet is formed on two (or three in another embodiment) occasions during the time when heat is applied by the thermal printing head. After the first dye image has been transferred, the elements are peeled apart. The second dye area of the donor element or second dye-donor element (respectively third) is then brought in register with the dye-receiving element and the process repeated.

Optionally, after completion of the subsequent passes and peeling apart of the donor and receiving element the receiving element is reheated integrally in order to increase the diffusion of the transferred dyes into the receiving layer as is described in EP 381740 and EP 97493.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically adressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The method and the dye-donor elements of the present invention are preferably used for obtaining a black-and-white hardcopy of a medical diagnostic image preferably on a transparent or blue-colored support.

The following examples are provided to illustrate the invention in more detail without limiting, however, the scope thereof.

EXAMPLES

A first dye-donor element for use according to thermal dye sublimation transfer was prepared as follows:

A solution comprising a dye or a mixture of dyes (the nature of the dye(s) and the amount (in wt %) of dye(s) being defined in table 1), 2.5 wt % of biphenylcarbonate as thermal solvent and 6 wt % of poly(styrene-co-acrylonitrile) as binder in methylethylketone as solvent was prepared. From this solution a layer having a wet thickness of 10 um was coated on 6 um thick polyethylene terephthalate film. The resulting layer was dried by evaporation of the solvent.

The back side of the polyethylene terephthalate film was provided with a slipping layer coated from a solution containing 13 wt % poly(styrene-co-acrylonitrile) binder and 1 wt % polysiloxane-polyether copolymer as lubricant.

A second dye-donor element differing in nature and/or amount of dye(s) was prepared in an analoguous manner, the nature and amount of dye(s)being defined in table 1.

A receiving element for use according to thermal dye sublimation transfer was prepared as follows:

A receiving layer containing 7.2 g/m$^2$ poly(vinylchloride-co-vinylacetate-co-vinylalcohol) (VINYLITE VAGD supplied by Union Carbide). 0.72 g/m$^2$ diisocyanate (DESMODUR VL supplied by Bayer AG) and 0.2 g/m$^2$ hydroxy modified polydimethylsiloxane (TEGOMER H SI 2111 supplied by Goldschmidt) was provided on a 170 um thick blue-colored polyethylene terephthalate film.

The first dye-donor element was printed in combination with the receiving element in a Mitsubishi color video printer CP100E.

The receiver sheet was separated from the dye-donor element and the color density of the first transferred image on the receiving sheet (D1) in the red (Dr), green (Dg) and blue (Db) region was measured by means of a Macbeth densitometer type TD 102 (Wratten filters 92, 83 and 94).

Thereafter the second dye-donor element was printed in combination with the receiving element in register with the first transferred dye image in the same printer.

The receiver sheet was separated from the second dye-donor element and the color density of the superposed transferred image having a black hue on the receiving sheet (D2) in the red (Dr), green (Dg) and blue (Db) region was measured by means of a Macbeth densitometer type TD 102 (Wratten filters 92, 93 and 94).

This experiment was repeated for each of the combination of first and second dye-donor element identified in table 1 below.

The results are listed in table 2 below.

TABLE 1

| Example No. | 1e donor element | 2e donor element |
|---|---|---|
| 1 | 10% M1, 6% C1 | 5% Y1 |
| Comparative 1 | 5% Y1 | 10% M1, 6% C1 |
| 2 | 5% M1, 6% C1 | 5% M1, 5% Y1 |
| Comparative 2 | 5% M1, 5% Y1 | 5% M1, 6% C1 |
| 3 | 5% M1, 3% C1, 5% Y3 | 5% M1, 3% C1, 3% Y1 |
| Comparative 3 | 5% M1, 3% C1, 3% Y1 | 5% M1, 3% C1, 5% Y3 |
| 4 | 5% M2, 3% C2, 2.5% Y1 | 5% M1, 3% C1, 3% Y2 |
| Comparative 4 | 5% M1, 3% C1, 3% Y2 | 5% M2, 3% C2, 2.5% Y1 |
| 5 | 5% M1, 4% C1, 1% Y1 | 5% M1, 2% C1, 4% Y1 |
| 6 | 5% M1, 4% C1, 2% Y1 | 5% M1, 2% C1, 3% Y1 |
| Comparative 5 | 5% M1, 3% C1, 2.5% Y1 | 5% M1, 3% C1, 2.5% Y1 |
| Comparative 6 | 5% M1, 2% C1, 4% Y1 | 5% M1, 4% C1, 1% Y1 |

Dye M2 corresponds to the following formula

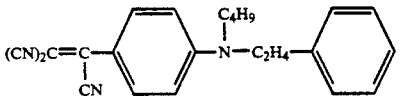

TABLE 2

| Example No. | D1 Dr | D1 Dg | D1 Db | D2 Dr | D2 Dg | D2 Db | sum D |
|---|---|---|---|---|---|---|---|
| 1 | 1.84 | 2.24 | 0.37 | 1.71 | 1.90 | 2.46 | 6.07 |
| Comparative 1 | 0.00 | 0.12 | 2.03 | 1.87 | 2.32 | 1.62 | 5.81 |
| 2 | 1.82 | 1.40 | 2.24 | 1.80 | 2.48 | 2.36 | 6.64 |
| Comparative 2 | 0.67 | 1.48 | 2.19 | 2.03 | 2.40 | 1.55 | 5.98 |
| 3 | 1.52 | 1.52 | 1.08 | 2.14 | 2.73 | 2.50 | 7.37 |
| Comparative 3 | 1.54 | 1.56 | 1.57 | 2.04 | 2.56 | 2.15 | 6.75 |
| 4 | 0.88 | 2.03 | 1.61 | 2.32 | 3.23 | 2.72 | 8.27 |
| Comparative 4 | 1.58 | 1.57 | 1.38 | 2.14 | 3.20 | 2.70 | 8.04 |
| 5 | 1.69 | 1.52 | 0.68 | 2.10 | 2.72 | 2.68 | 7.50 |
| 6 | 1.12 | 1.48 | 1.10 | 2.11 | 2.78 | 2.62 | 7.51 |
| Comparative 5 | 1.35 | 1.37 | 1.26 | 2.04 | 2.56 | 2.42 | 7.02 |
| Comparative 6 | 1.31 | 1.54 | 1.98 | 2.12 | 2.56 | 2.10 | 6.78 |

Sum D in table 2 represents Dr+Dg+Db of D2 and is a measure of the efficiency of the thermal dye transfer process and a measure of the total amount of dye transferred to the receiving layer.

The degree of retransfer of C1 is higher than the degree of retransfer of C2, the degree of retransfer of M1 is comparable to the degree of retransfer of M2, the degree of retransfer of Y1 is comparable to the degree of retransfer of Y2 and are both higher than the degree of retransfer of Y3. The degree of retransfer of the yellow dyes Y1 and Y2 is higher than the degree of retransfer of the magenta dyes M1 and M2 and the cyan dyes C1 and C2.

Example No. 1 and Comparative 1 (respectively 2 and comparative 2) show that when Y1, the dye with a higher retransfer degree than M1 and C1, is transferred in the second pass instead of the first pass higher densities in the blue region and higher transfer efficiencies (sum D) are obtained.

Example No. 3 and Comparative 3 show that when Y1, the dye with a higher retransfer degree than Y3, is transferred in the second pass instead of the first pass higher densities in the blue region and higher transfer efficiencies (sum D) are obtained.

Example No. 4 and Comparative 4 show that when C1, the dye with a higher retransfer degree than C2, is transferred in the second pass instead of the first pass higher densities in the red region and higher transfer efficiencies are obtained.

Example No. 5, 6 and Comparative 5 show that when the dyes having the highest retransfer degree (Y1) are contained in the second dye area or dye-donor element in a higher concentration than in the first area or dye-donor element higher transfer densities and transfer efficiencies are obtained than in the case where both areas or donor elements contain the same dyes in the same concentrations.

Example No. 5 and Comparative 6 show that when both areas or donor elements contain the same dyes but in different concentrations, the highest transfer densities and transfer efficiencies are obtained if the concentration of the dyes having the highest degree of retransfer (Y1) is higher in the second area or donor element than in the first area or donor element.

I claim:

1. Thermal dye transfer printing method for obtaining high density black images comprising the steps of (1) imagewise heating a first area of a dye-donor element or an entire first dye-donor element comprising a support having thereon a dye layer containing a dye or a mixture of dyes thereby transferring a first dye image to a dye-receiving element comprising a support having thereon a dye image-receiving layer and (2) subsequently imagewise heating a second area of said dye-donor element or an entire second dye donor element thereby transferring in register with the first dye image a second dye image to said dye-receiving element wherein the superposition of the first transferred dye image and the second transferred dye image yield a black dye image, characterized in that the concentration of those essential composing dyes having a higher retransfer degree than the other essential composing dyes is higher in the second area or in the second dye-donor element than in the first area or first dye-donor element.

2. Thermal dye transfer printing method according to claim 1, wherein the first area or first dye-donor element and the second area or second dye-donor element contain different dyes or dye mixtures with those essential composing dyes having a higher retransfer degree than the other essential composing dyes being present only in the second area or second dye-donor element.

3. Thermal dye transfer printing method according to claim 1, wherein the first area or first dye-donor element and the second area or second dye-donor element contain the same dyes in different concentrations with those essential composing dyes having a higher retransfer degree than the other essential composing dyes being present in the second area or second dye-donor element in a higher concentration than in the first area or first dye-donor element.

4. Thermal dye transfer printing method according to claim 1, wherein the dye image transferred from the first area or first dye-donor element and the dye image transferred from the second area or second dye-donor element have a different hue.

5. Thermal dye transfer printing method according to claim 1, wherein at least one of the dye areas or dye-donor elements contains at least one magenta 4-chloro, 5-formylthiazol-2-ylazoaniline dye.

6. Thermal dye transfer printing method according to claim 1, wherein the support of the dye-receiving element is transparant or blue-colored polyethylene terephthalate.

7. Thermal dye transfer printing method according to claim 1, wherein the dye image-receiving layer comprises the heat-cured product of poly(vinylchloride-co-vinylacetate-co-vinylalcohol) and polyisocyanate.

8. Dye-donor element having sequential repeating first and second dye areas for use according to the method as defined in claim 1.

9. Thermal dye transfer printing method for obtaining high density black images comprising the steps of (1) imagewise heating a first area of a dye-donor element or an entire first dye-donor element comprising a support having thereon a dye layer containing a dye or a mixture of dyes thereby transferring a first dye image to a dye-receiving element comprising a support having thereon a dye image-receiving layer and (2) subsequently imagewise heating a second area of said dye-donor element or an entire second dye-donor element thereby transferring in register with the first second dye image to said dye-receiving element and (3) subsequently imagewise heating a third area of said dye-donor element of an entire dye-donor element thereby transferring in register with the first and second dye image a third dye image to said dye-receiving element wherein the superposition of the first transferred dye image, the second transferred dye image and the third transferred dye image yield a black dye image, characterized in that the concentration of those essential composing dyes having a higher retransfer degree than the other essential composing dyes is higher in an area or dye-donor element to be printed in a later pass than in an area or dye-donor element to be printed in an earlier pass and that at least one of the dye areas or dye-donor elements contains a mixture of dyes wherein at least two dyes have a difference in maximum absorption of at least 50 nm.

10. Dye-donor element having sequential repeating first, second and third dye areas for use according to the method as defined in claim 9.

* * * * *